US005958089A

United States Patent [19]

Dillworth et al.

[11] Patent Number: 5,958,089

[45] Date of Patent: Sep. 28, 1999

[54] ADDITIVES AND FUEL OIL COMPOSITIONS

[75] Inventors: Brid Dillworth, Oxfordshire; Rinaldo Caprotti, Oxford, both of United Kingdom

[73] Assignee: Exxon Chemical Patents, Inc., Linden, N.J.

[21] Appl. No.: 08/875,649

[22] PCT Filed: Feb. 2, 1996

[86] PCT No.: PCT/EP96/00451

§ 371 Date: Sep. 17, 1997

§ 102(e) Date: Sep. 17, 1997

[87] PCT Pub. No.: WO96/23855

PCT Pub. Date: Aug. 8, 1996

[30] Foreign Application Priority Data

Feb. 2, 1995 [GB] United Kingdom ..... 9502041

[51] Int. Cl.[6] ..... C10L 1/22; C10L 1/18

[52] U.S. Cl. ..... 44/347; 44/404

[58] Field of Search ..... 44/347, 404

[56] References Cited

U.S. PATENT DOCUMENTS

| | | | |
|---|---|---|---|
| 3,346,355 | 10/1967 | Eckert | 44/404 |
| 3,720,615 | 3/1973 | Izumi et al. | 44/404 |
| 4,032,304 | 6/1977 | Dorer, Jr. et al. | 44/347 |
| 4,185,594 | 1/1980 | Perilstein | 44/404 |
| 4,508,637 | 4/1985 | Heintzelman et al. | 44/404 |
| 4,509,951 | 4/1985 | Knapp | 44/404 |
| 4,511,366 | 4/1985 | Burrows et al. | 44/404 |
| 5,378,249 | 1/1995 | Morrison | 44/388 |
| 5,525,127 | 6/1996 | Jeffrey | 44/347 |

FOREIGN PATENT DOCUMENTS

| | | | |
|---|---|---|---|
| 441014 | 8/1991 | European Pat. Off. . | |
| 460957 | 12/1991 | European Pat. Off. . | |
| 526129 | 2/1993 | European Pat. Off. | C10L 1/14 |
| 555006 | 8/1993 | European Pat. Off. . | |
| 569228 | 11/1993 | European Pat. Off. . | |
| 634472 | 1/1995 | European Pat. Off. . | |
| 1310847 | 3/1973 | United Kingdom | C10L 1/18 |
| WO92/02601 | 2/1992 | WIPO . | |
| WO94/17160 | 8/1994 | WIPO . | |
| WO94/20593 | 9/1994 | WIPO . | |
| WO95/03377 | 2/1995 | WIPO . | |
| WO96/23855 | 8/1996 | WIPO . | |

*Primary Examiner*—Ellen M. McAvoy

*Attorney, Agent, or Firm*—Ohlandt, Greeley, Ruggiero & Perle

[57] ABSTRACT

An additive composition comprising: (a) an ashless dispersant comprising an acylated nitrogen compound; and (b) a carboxylic acid, or an ester of the carboxylic acid and an alcohol wherein the acid has from 2 to 50 carbon atoms and the alcohol has one or more carbon atoms, which provides an improvement in the lubricity of fuel oils and exhibits improved solubility in the fuel oil.

17 Claims, No Drawings

ADDITIVES AND FUEL OIL COMPOSITIONS

This invention relates to additives for improving the lubricity of fuel oils such as diesel fuel oil. Diesel fuel oil compositions including the additives exhibit improved lubricity and reduced engine wear.

Concern for the environment has resulted in moves to significantly reduce the noxious components in emissions when fuel oils are burnt, particularly in engines such as diesel engines. Attempts are being made for example to minimise sulphur dioxide emissions resulting from the combustion of fuel oils. As a consequence attempts are being made to minimise the sulphur content of diesel fuel oils. Although typical diesel fuel oils have in the past contained 1% by weight or more of sulphur (expressed as elemental sulphur) it is now considered desirable to reduce the level, preferably to 0.05% by weight and, advantageously, to less than 0.01% by weight.

The additional refining of the fuel oils, necessary to achieve these low sulphur levels, often results in reductions in the level of other polar components. In addition, refinery processes can reduce the level of polynucleararomatic compounds present in such fuel oils.

Reducing the level of one or more of the sulphur, polynucleararomatic or polar components of diesel fuel oil can reduce the ability of the oil to lubricate the injection system of the engine so that, for example, the fuel injection pump of the engine fails relatively early in the life of an engine. Failure may occur in high pressure fuel injection systems such as high pressure rotary distributors, in-line pumps and injectors.

The problem of poor lubricity in fuel oils is likely to be exacerbated by the future engine developments aimed at further reducing emissions, which will have more exacting lubricity requirements than present engines. For example, the advent of high pressure unit injectors is anticipated to increase the fuel oil lubricity requirement and hence the demands on lubricity additives.

Environmental concerns are also encouraging the reduction in high-boiling components of fuel oils. Whereas middle distillate fuel oils typically have a 95% distillation point of up to 380° C. or even higher, moves to reduce this point to 360° C. or even 350° C. or lower are gaining momentum.

This reduction in the 95% distillation point has the result of limiting or excluding the presence of some naturally-occurring heavy n-alkanes from fuel oils.

Lowering the levels of both polynucleararomatic compounds and some heavy n-alkanes can alter the physical properties of the resulting fuel oils. It has now been found that lubricity additives hitherto used in the art and particularly those which are esters are poorly soluble in such fuel oils, particularly at low temperatures, leading to partial precipitation of these additives. As a result, the lubricity additives may not reach their intended sites of action further along the fuel system.

Furthermore, there is a continual need for additives with improved lubricity performance.

It has now been found that the lubricity of fuel oils, especially low sulphur, low 95% distillation point fuel oils can be improved by the use of an additive composition which also exhibits improved solubility in the fuel oil.

GB 1,310,847 discloses additives for cleaning the fuel systems of liquid fuel-burning engines and other fuel burning devices, the additive comprising a dispersant which may be an acylated nitrogen compound, and an oxy compound which may be an ester of a glycol, polyglycol, monoether glycol and monoether polyglycol with a mono carboxylic acid containing up to twenty carbon atoms.

WO-A-92/02601 discloses deposit control additives for fuels which comprise a polymer or copolymer of an olefinic hydrocarbon, a polyether, an N-substituted polyalkenyl succinimide of a polyamine and a polyol ester based on neopentyl glycol, pentaerythritol or trimethylol propane with corresponding monocarboxylic acids, an oligomer ester, or a polymer ester based on dicarboxylic acid, polyol and monoalcohol. The olefin polymer, polyether and ester form a carrier fluid for the succinimide.

EP-A-0 526 129 discloses fuel additives for controlling octane requirement increase, which comprise an unhydrotreated poly-a-olefin and the reaction product of a polyamine and an acyclic hydrocarbyl-substituted succinic acylating agent, and may also optionally comprise a corrosion inhibitor (E) which may be the half-ester of a polyglycol and an alkenylsuccinic acid having 8 to 24 carbon atoms in the alkenyl group.

According to the first aspect of the present invention there is provided a fuel oil composition comprising a major amount of a fuel oil containing not more than 0.05% by weight of sulphur and having a 95% distillation point of not greater than 350° C., and a minor amount of an additive composition comprising:

(a) an ashless dispersant comprising an acylated nitrogen compound, and (b) a carboxylic acid, or an ester of the carboxylic acid and an alcohol wherein the acid has from 2 to 50 carbon atoms and the alcohol has one or more carbon atoms.

In a second aspect of the invention there is provided an additive composition comprising:

(a) an ashless dispersant comprising an acylated nitrogen compound, and (b) a carboxylic acid, or an ester of the carboxylic acid and a polyhydric alcohol, wherein the acid has from 2 to 50 carbon atoms and the alcohol has one or more carbon atoms, and wherein the ester is not that formed by a monocarboxylic acid containing up to 20 carbon atoms and a glycol, polyglycol, monoether glycol or monoether polyglycol;

provided that the composition does not additionally comprise a polyether and polymer or copolymer of an olefinic hydrocarbon when (a) is an N-substituted polyalkenyl succinimide of a polyamine and (b) is a polyol ester based on neopentyl glycol, pentaerythritol or trimethylol propane and a monocarboxylic acid, an oligomer ester, or a polymer ester based on dicarboxylic acid, polyol and monoalcohol; and also provided that the composition does not additionally comprise an unhydrotreated poly-α-olefin when (a) is the reaction product of a polyamine and an acyclic hydrocarbyl-substituted succinic acylating agent, and (b) is the half-ester of a polyglycol and an alkenyl succinic acid having 8 to 24 carbons in the alkenyl group.

In a third aspect of the invention there is provided the use of the additive composition defined in the first aspect or of the second aspect, in a fuel oil to improve the lubricity performance thereof.

Whilst not wishing to be bound by any theory it is believed that when the additive is included in the fuel oil for use in a compression-ignition internal combustion engine, it is capable of forming at least partial mono- or multimolecular layers of a lubricating composition on the surfaces of the injection system, particularly the injector pump that are in moving contact with one another, the composition being such as to give rise, when compared with a composition lacking the additive, to one or more of a reduction in wear, a reduction in friction, or an increase in electrical contact resistance in any test where two or more loaded bodies are in relative motion under non-hydrodynamic lubricating conditions.

A major advantage of the additive composition of the invention is in greatly improving the lubricity of fuel oils containing less than 0.05 wt % of sulphur and having a 95% distillation point of not greater than 350° C. The combination of (a) and (b) can provide unexpected enhancements in lubricity performance. The additive composition of the invention also has good solubility in fuel oils, particularly at low temperatures. Whereas difficulties can arise in transporting fuel oils through lines and pumps because of precipitation of additives with subsequent blocking of fuel lines, screens and filters the combination of components in the additive composition of the present invention provides a mutually compatible, soluble combination in the fuel oil. The fuel oil composition of the present invention exhibits a high degree of homogeneity and freedom from suspended solid or semi-solid material as measured by a high filterability, particularly at low temperatures.

The Fuel Oil Composition (First Aspect of the Invention)

The fuel oil composition comprises a major amount of fuel oil and a minor amount of the additive composition, as hereinafter defined.

The Fuel Oil

The fuel oil may be a petroleum-based fuel oil, suitably a middle distillate fuel oil, i.e. a fuel oil obtained in refining crude oil as the fraction between the lighter kerosene and jet fuels fraction and the heavy fuel oil fraction. Such distillate fuel oils generally boil above about 100° C. The fuel oil can comprise atmospheric distillate or vacuum distillate, or cracked gas oil or a blend in any proportion of straight run and thermally and/or catalytically cracked distillates. The most common petroleum-based fuel oils are kerosene, jet fuels and diesel fuel oils. A preferred specification for a diesel fuel oil for use in the present invention includes a minimum flash point of 38° C.

The sulphur content of the fuel oil is 0.05% by weight or less, preferably 0.03% for example 0.01% by weight or less, more preferably 0.005% by weight or less, and most preferably 0.001% by weight or less based on the weight of the fuel oil. The art describes methods for reducing the sulphur content of hydrocarbon middle distillate fuels, such methods including solvent extraction, sulphuric acid treatment, and hydrodesulphurisation.

The fuel oil also has a 95% distillation point of not greater than 350° C., preferably not greater than 340° C. and more preferably, not greater than 330° C., as measured by ASTM-D86.

Preferred fuel oils have a cetane number of at least 50. The fuel oil may have a cetane number of at least 50 prior to the addition of any cetane improver or the cetane number of the fuel may be raised to at least 50 by the addition of a cetane improver.

More preferably, the cetan number of the fuel oil is at least 52.

The Additive Composition (a) Component (a) of the additive composition is an ashless dispersant comprising an acylated nitrogen compound, preferably having a hydrocarbyl substitutent of at least 10 aliphatic carbon atoms, made by reacting a carboxylic acid acylating agent with at least one amine compound containing at least one —NH—group, said acylating agent being linked to said amino compound through an imido, amido, amidine or acyloxy ammonium linkage.

A number of acylated, nitrogen-containing compounds having a hydrocarbyl substituent of at least 10 carbon atoms and made by reacting a carboxylic acid acylating agent, for example an anhydride or ester, with an amino compound are known to those skilled in the art. In such compositions the acylating agent is linked to the amino compound through an imido, amido, amidine or acyloxy ammonium linkage. The hydrocarbyl substituent of 10 carbon atoms may be found either in the portion of the molecule derived from the carboxylic acid acylating agent, or in the portion derived from the amino compound, or in both. Preferably, however, it is found in the acylating agent portion. The acylating agent can vary from formic acid and its acylating derivatives to acylating agents having high molecular weight hydrocarbyl substituents of up to 5000, 10000 or 20000 carbon atoms. The amino compounds can vary from ammonia itself to amines having hydrocarbyl substituents of up to about 30 carbon atoms.

A preferred class of acylated amino compounds are those made by reacting an acylating agent having a hydrocarbyl substituent of at least 10 carbon atoms and a nitrogen compound characterized by the presence of at least one —NH—group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The hydrocarbyl substituent in such acylating agents preferably averages at least about 30 or 50 and up to about 400 carbon atoms.

Illustrative of hydrocarbyl substituent groups containing at least 10 carbon atoms are n-decyl, n-dodecyl, tetrapropenyl, n-octadecyl, oleyl, chlorooctadecyl, triicontanyl, etc. Generally, the hydrocarbyl substituents are made from homo- or interpolymers (e.g. copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. This substituent can also be derived from the halogenated (e.g. chlorinated or brominated) analogs of such homo-or interpolymers. The substituent can, however, be made from other sources such as monomeric high molecular weight alkenes (e.g. 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g. poly(ethylene) greases) and other sources known to those skilled in the art. Any unsaturation in the substituent may be reduced or eliminated by hydrogenation according to procedures known in the art.

The term hydrocarbyl denotes a group having a carbon atom directly attached to the remainder of the molecule and which has a predominantly aliphatic hydrocarbon character. Therefore, hydrocarbyl substituents can contain up to one non-hydrocarbyl group for every 10 carbon atoms provided that this non-hydrocarbyl group does not significantly alter the predominantly aliphatic hydrocarbon character of the group. Those skilled in the art will be aware of such groups, which include, for example, hydroxyl, halo (especially chloro and fluoro), alkoxyl, alkyl mercapto, alkyl sulfoxy, etc. Usually, however, the hydrocarbyl substituents are purely aliphatic hydrocarbon in character and do not contain such groups.

The hydrocarbyl substituents are predominantly saturated. The hydrocarbyl substituents are also predominantly aliphatic in nature, that is, they contain no more than one non-aliphatic moiety (cycloalkyl, cycloalkenyl or aromatic) group of 6 or less carbon atoms for every 10 carbon atoms in the substituent. Usually, however, the substituents contain no more than one such non-aliphatic group for every 50 carbon atoms, and in many cases, they contain no such non-aliphatic groups at all; that is, the typically substituents are purely aliphatic. Typically, these purely aliphatic substituents are alkyl or alkenyl groups.

Specific examples of the predominantly saturated hydrocarbyl substituents containing an average of more than 30 carbon atoms are the following: a mixture of poly(ethylene/propylene) groups of about 35 to about 70 carbon atoms; a mixture of poly(propylene/1-hexene) groups of about 80 to about 150 carbon atoms; a mixture of poly(isobutene) groups having an average of 50 to 75 carbon atoms; a mixture of poly (1-butene) groups having an average of 50–75 carbon atoms.

A preferred source of the substituents are poly(isobutene)s obtained by polymerization of a C4 refinery stream having a butene content of 35 to 75 weight per cent and isobutene content of 30 to 60 weight per cent in the presence of a Lewis acid catalyst such as aluminium trichloride or boron trifluoride. These polybutenes predominantly contain monomer repeating units of the configuration $$—C(CH_3)_2CH_2—$$

Examples of amino compounds useful in making these acylated compounds are the following:

(1) polyalkylene polyamines of the general formula IV $$(R^6)_2N[U—N(R^6)]q(R^6)_2 \quad \text{IV}$$

wherein each $R^6$ independently represents a hydrogen atom, a hydrocarbyi group or a hydroxy-substituted hydrocarbyl group containing up to about 30 carbon atoms, with the proviso that at least one $R^6$ represents a hydrogen atom, q represents an integer in the range from 1 to 10 and U represents a $C_{1-18}$ alkylene group;

(2) heterocyclic-substituted polyamines including hydroxyalkyl-substituted polyamines wherein the polyamines are described above and the heterocyclic substituent is for example a piperazine, an imidazoline, a pyrimidine, or a morpholine; and (3) aromatic polyamines of the general formula V $$Ar(NR^6{}_2)y \quad \text{V}$$

wherein Ar represents an aromatic nucleus of 6 to about 20 carbon atoms, each $R^6$ is as defined hereinabove and y represents a number from 2 to about 8.

Specific examples of the polyalkylene polyamines (1) are ethylene diamine, tetra(ethylene)pentamine, tri-(trimethylene)tetramine, and 1,2-propylene diamine. Specific examples of hydroxyalkyl-substituted polyamines include N-(2-hydroxyethyl) ethylene diamine, N,$N^1$-bis-(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3-(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763 and 4,234,435, and including European patent applications EP 0 336 664 and EP 0 263 703. A typical and preferred compound of this class is that made by reacting a poly (isobutylene)-substituted succinic anhydride acylating agent (e.g. anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene groups. In view of the extensive disclosure of this type of acylated amino compound, further discussion of their nature and method of preparation is not needed here. The above-noted US patents are utilized for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the mono-carboxylic acid are formic acid, acetic acid, dodecanoic acid, butanoic acid, oleic acid, stearic acid, the commercial mixture of stearic acid isomers known as isosteric acid, tolyl acid, etc. Such materials are more fully described in U.S. Pat. Nos. 3,216,936 and 3,250,715.

Still another type of acylated nitrogen compound useful as compatibilising agent is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12–30 carbon atoms. A widely used type of acylating nitrogen compound is made by reacting the afore-described alkylene polyamines with a mixture of fatty acids having from 5 to about 30 mole per cent straight chain acid and about 70 to about 95 mole per cent branched chain fatty acids. Among the commercially available mixtures are those known widely in the trade as isostearic acid. These mixtures are produced as by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chlorostearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are utilized for their disclosure of fatty acid-polyamine condensates for their use in oleaginous formulations.

The preferred acylated nitrogen compounds are those made by reacting a poly (isobutene) substituted succinic anhydride acylating agent with mixtures of ethylene polyamines as hereinbefore described.

(b) Component (b) of the additive composition is a carboxylic acid (i) or an ester (iii) of the carboxylic acid (i) and an alcohol (ii).

The acid, alcohol and ester will now be discussed in further detail as follows.

(i) Acid

The acid may be a mono or polycarboxylic acid such as aliphatic, saturated or unsaturated, straight or branched chain, mono and dicarboxylic acids being preferred. For example, the acid may be generalised in the formula $$R'(COOH)_x$$

where x represents an integer and is 1 or more such as 1 to 4, and R' represents a hydrocarbyl group having from 2 to 50 carbon atoms and which is mono or polyvalent corresponding to the value of x, the —COOH groups, when more than one is present, optionally being substituent on different carbon atoms from one another.

'Hydrocarbyl' has the same meaning as given above for component (a).

Preferably, when the acid is monocarboxylic, the hydrocarbyl group is an alkyl group or an alkenyl group having 10 (e.g. 12) to 30 carbon atoms, i.e. the acid is saturated or unsaturated. The alkenyl group may have one or more double bonds, such as 1, 2 or 3. Examples of saturated carboxylic acids are those with 10 to 22 carbon atoms such as capric, lauric, myristic, palmitic, and behenic acids and examples of unsaturated carboxylic acids are those with 10 to 22 carbon atoms such as oleic, elaidic, palmitoleic, petroselic, riconoleic, eleostearic, linoleic, linolenic, eicosanoic, galoleic, erucic and hypogeic acids. When the acid is polycarboxylic, having for example from 2 to 4 carboxy groups, the hydrocarbyl group is preferably a substituted or unsubstituted polymethylene and may have 10 to 40 carbon atoms, for example 32 to 36 carbon atoms. The polycarboxylic acid maybe a diacid, for example a dimer acid formed by dimerisation of unsaturated fatty acids such as linoleic or oleic acid, or mixtures thereof.

(ii) Alcohol

The alcohol from which the ester (iii) is derived may be a mono or polyhydroxy alcohol such as a trihydroxy alcohol. For example, the alcohol may be generalised in the formula $$R^2(OH)_y$$

where y represents an integer and is 1 or more and preferably 2 or more, for example 3 or more and $R^2$ represents a hydrocarbyl group having 1 or more carbon atoms such as up to 10 carbon atoms, and which is mono or polyvalent corresponding to the value of y, the —OH groups, when more than one is present, optionally being substituent on different carbon atoms from one another.

'Hydrocarbyl' has the same meaning as given above for the acid. For the alcohol, the hydrocarbyl group is preferably an alkyl group or a substituted or unsubstituted polymethylene group. Examples of monohydric alcohols are lower alkyl alcohols having from 1 to 6 carbon atoms such as methyl, ethyl, propyl and butyl alcohols.

Examples of polyhydric alcohols are aliphatic, saturated or unsaturated, straight chain or branched alcohols having 2 to 10, preferably 2 to 6, more preferably 2 to 4, hydroxy groups, and having 2 to 90, preferably 2 to 30. more preferably 2 to 12, most preferably 2 to 5, carbon atoms in the molecule. As more particular examples the polyhydric alcohol may be a diol, glycol or polyglycol, or a trihydric alcohol such as glycerol or sorbitan.

(iii) The Esters

The esters may be used alone or as mixtures with one or more acids or one or more esters and may be composed only of carbon, hydrogen and oxygen. Preferably the ester has a molecular weight of 200 or greater, or has at least 10 carbon atoms, or has both.

Examples of esters that may be used are lower alkyl esters, such as methyl esters, of the above exemplified saturated or unsaturated monocarboxylic acids. Such esters may for example, be obtained by saponification and esterification of natural fats and oils of plant or animal origin or by their transesterification with lower aliphatic alcohols.

Examples of esters of polyhydric alcohols that may be used are those where all of the hydroxy groups are esterified, those where not all of the hydroxy groups are esterified, and mixtures thereof. Specific examples are esters prepared from glycols, diols or trihydric alcohols and one or more of the above-mentioned saturated or unsaturated carboxylic acids, such as glycerol monoesters and glycerol diesters, e.g. glycerol monooleate, glycerol dioleate and glycerol monostearate. Further examples include the esters formed from dimer acids and glycols or polyglycols, optionally terminated with monoalcohols such as methanol. Such polyhydric esters may be prepared by esterification as described in the art and/or may be commercially available.

The ester may have one or more free hydroxy groups.

The ratio of component (a):component (b), calculated on a weight:weight basis, is advantageously greater than 1:100, preferably greater than 1:50, more preferably greater than 1:25, and most favourably greater than 1:4. The greater the ratio of (a):(b), the more soluble the resulting additive composition appears in the fuel oil.

For optimum lubricity enhancement, the ratio of component (a): component (b), calculated on a weight: weight basis, is preferably in the range of 1:2 to 2:1.

The Additive Composition (Second Aspect of the Invention)

Preferred under the second aspect are those additive compositions defined in relation to the first aspect, wherein the ester is of a polyhydric alcohol.

The additive composition may be incorporated into a concentrate in a suitable solvent. Concentrates are convenient as a means for incorporating the additives into bulk fuel oil. Incorporation may be by methods known in the art. The concentrate preferably contains from 3 to 75 wt %, more preferably 3 to 60 wt %, most preferably 10 to 50 wt % of the additive preferably in solution. Examples of carrier liquids are organic solvents including hydrocarbon solvents, for example petroleum fractions such as naphtha, kerosene, diesel and heater oil: aromatic hydrocarbons such as aromatic fractions, e.g. those sold under the 'SOLVESSO' trade name; paraffinic hydrocarbons such as hexane and pentane and isoparaffins; alcohols; esters, and mixtures of one or more of the above. The carrier liquid must, of course, be selected having regard to its compatibility with the additive and with the fuel oil.

The additive composition of the invention may be incorporated into bulk oil by other methods such as those known in the art. The components (a) and (b) of the additive composition of the invention may be incorporated into the bulk oil at the same time or at a different time, to form the fuels oil compositions of the invention.

The Use (Third Aspect of the Invention)

The additive composition may be used to improve the lubricity performance of those fuels oils containing not more than 0.05% wt sulphur, and particularly those fuel oils defined under the first aspect of the invention.

Treat Rates

The concentration of the additive composition of the invention in the fuel oil may for example be in the range of 10 to 5,000 ppm of additive (active ingredient) by weight per weight of fuel oil, for example 30 to 5,000 ppm such as 1 00 to 2000 ppm (active ingredient) by weight per weight of fuel, preferably 150 to 500 ppm, more preferably 200 to 400 ppm.

When the additive composition is in the form of an additive concentrate the components will be present in combination in amounts found to be mutually effective from measurement of their performance in fuels.

The methods of assessing the benefits obtained from the presence of the additive composition in fuel oil will now be described.

As stated, it is believed that the additive composition is capable of forming at least partial layers of a lubricating composition on certain surfaces of the engine. By this is meant that the layer formed is not necessarily complete on the contacting surface. The formation of such layers and the extent of their coverage of a contacting surface can be demonstrated by, for example measuring electrical contact resistance or electrical capacitance.

Examples of tests that can be used to demonstrate one or more of a reduction in wear, a reduction in friction or an increase in electrical contact resistance according to this invention are the Ball On Cylinder Lubricant Evaluator and High Frequency Reciprocating Rig tests.

The Ball On Cylinder Lubricant Evaluator (or BOCLE) test described in Friction and wear devices, 2nd Ed., p. 280, American Society of Lubrication Engineers, Park Ridge III, USA; and F. Tao and J. Appledorn, ASLE trans., 11, 345–352 (1968); and The High Frequency Reciprocating Rig (or HFRR) test described in D. Wei and H. Spikes, Wear, Vol. 111, No. 2, p.217, 1986; and R. Caprotti, C. Bovington, W. Fowler and M. Taylor, SAE paper 922183; SAE fuels and lubes, meeting Oct. 1992; San Francisco, USA.

The extent to which the additive composition remains in solution in the fuel oil at low temperatures or at least does not form a separate phase which can cause blocking of fuel oil lines or filters can be measured using a known filterability test. For example, a method for measuring the filterability of fuel oil compositions at temperatures above their cloud point is described in the Institute of Petroleum's Standard designated "IP 387/190" and entitled "Determination of filter blocking tendency of gas oils and distillate diesel fuels". In summary, a sample of the fuel oil composition to be tested is passed at a constant rate of flow through a glass fibre filter medium: the pressure drop across the filter is monitored, and the volume of fuel oil passing the filter medium within a prescribed pressure drop is measured. The filter blocking tendency of a fuel composition can be described as the pressure drop across the filter medium for 300 ml of fuel to pass at a rate of 20 ml/min. Reference is to be made to the above-mentioned Standard for further information. In assessing the additive composition of the present invention this method was adapted by conducting the measurements at temperatures lower than that specified in the Standard.

The invention is further illustrated by reference to the following Examples.

EXAMPLE 1

The following materials and procedures were used.

Fuel Oil

A diesel fuel oil having a sulphur content of 0.05% by weight of sulphur, a cetane number of 50.6 and a 95% distillation point of 340.5° C., and having the additional characteristics shown below:

| | |
|---|---|
| Cloud Point | −7° C. |
| Distillation Characteristics (ASTM D86) | |
| IBP | 161.6° C. |
| 10% | 195.1° C. |
| 20% | 207.7° C. |
| 30% | 218.2° C. |
| 40% | 229.6° C. |
| 50% | 241.9° C. |
| 60% | 255.6° C. |
| 70% | 271.5° C. |
| 80% | 291.3° C. |
| 90% | 318.9° C. |
| FBP | 361.7° C. |

Additives

Additives A and B were added to the fuel oil in the proportions recorded in Table 1, and after thorough mixing the fuel compositions were evaluated in the High Frequency Reciprocating Rig Test. The results are given in Table 1 as the wear scar diameter. Also recorded is the percentage reduction in wear scar diameter in comparison with the wear scar diameter observed for the fuel oil not containing the additives.

TABLE 1

| Experiment | Additive | Additive Concentration (ppm active ingredient (wt/wt)) | Wear Scar (μm) | Reduction Wear (%) |
|---|---|---|---|---|
| 1 | None | Nil | 540 | 0 |
| 2 | B | 150 | 355 | 34 |
| 3 | A | 63 | 370 | 31 |
| | B | 150 | | |

Additives

A: A succinimide ashless dispersant being the reaction product of 1.5 equivalents of PIBSA (polyisobutyl succinic anhydride, with polyisobutylene number average molecular weight of approximately 950, as measured by Gel Permeation Chromatography) with one equivalent of polyethylene polyamine mixture of average composition approximating to pentaethylene hexamine. The reaction product is thus believed to be a mixture of compounds predominating in the 1:1 PIBSA:polyamine adduct, a compound in which one primary amine group of each polyamine remains unreacted.

B: A reaction product of equimolar amounts of ethylene glycol and dilinoleic acid, subsequently reacted with methanol, being a mixture of esters within the definition of component (b) as hereinbefore described.

As can be seen from Table 1, the additive formulations in experiments 2 and 3 both gave a significant reduction in wear.

EXAMPLE 2

Further High Frequency Reciprocating Rig tests were conducted in a second diesel fuel oil having the following characteristics:

| | |
|---|---|
| Sulphur Content | 0.03% wt |
| Cetane No. | 51 |
| Cloud Point | −10° C. |
| Distillation Characteristics (ASTM D86) | |
| IBP | 161.4° C. |
| 10% | 193.7° C. |
| 20% | 205.2° C. |
| 30% | 215.1° C. |
| 40% | 226.1° C. |
| 50% | 238.4° C. |
| 60% | 251.6° C. |
| 70% | 266.7° C. |
| 80% | 285.1° C. |

-continued

| | |
|---|---|
| 90% | 313.4° C. |
| 95% | 339.9° C. |
| FBP | 360.8° C. |

Additives A and B from Example 1, together with Additive E (a commercial mixture of dimmer fatty acids, predominantly dilinoleic acid) were added to this fuel oil in the proportions recorded in Table 2, and the wear scar diameters measured.

TABLE 2

| Experiment | Additive | Additive Concentration (ppm active ingredient (wt/wt)) | Wear Scar (μm) | Reduction Wear (%) |
|---|---|---|---|---|
| 4 | None | Nil | 540* | — |
| 5 | B | 125 | 415 | 23 |
| 6 | A | 126 | 475 | 12 |
| 7 | A | 210 | 415 | 23 |
| 8 | A | 126 | 250 | 54 |
| | B | 125 | | |
| 9 | E | 85+ | 455 | 16 |
| 10 | A | 126 | 270 | 50 |
| | E | 85+ | | |

*Average of two results.
+estimated active ingredient level within commercial mixture.

As can be seen, the fuel compositions of the invention (8 and 10) showed greatly superior HFRR performance, confirming the good lubricity provided by combinations of (a) and (b)

EXAMPLE 3

A third diesel fuel oil was treated with various amounts of Additive A of Example 1 and the ester sorbitan mono-oleate (Additive C), as detailed in Table 3. The mixtures were assessed for filterability according to the IP 387/90 filterability at the temperature recorded in Table 3.

The fuel oil had the following characteristics:

| | |
|---|---|
| Cetane Number | 51.6 |
| Sulphur (wt) | 0.00045% |
| Distillation Characteristics (ASTM D86) | |
| 50% | 237.1° C. |
| 90% | 260.6° C. |
| FBP | 294.1° C. |

TABLE 3

| Experiment | Additive | Additive Concentration (ppm active ingredient (wt/wt)) | Temperature (° C.) | Pass/ Fail | Pressure (psi) |
|---|---|---|---|---|---|
| 11 | C | 200 | −20 | Fail | – |
| 12 | C | 200 | −20 | Pass | 3.4 |
| | A | 2.3 | | | |
| 13 | C | 200 | −20 | Pass | 3.3 |
| | A | 4.5 | | | |
| 14 | C | 200 | −20 | Pass | 12 |
| | A | 9.0 | | | |

As can be seen from Table 3, the fuel compositions of the invention (12, 13 and 14) each passed the filterability test, while the fuel composition comprising the ester alone failed.

EXAMPLE 4

The diesel fuel oil of example 3 was treated with various amounts of Additive A of example 1 and the ester glycerol mono-oleate (Additive D), as detailed in Table 4. The mixtures were repeatelly assessed for filterability according to the IP387/190 filterability test at a temperature of 0° C., over a period of up to 35 days.

TABLE 4

| Experiment | Additive | Additive Concentration (ppm active ingredient (wt/wt)) | Temperature (° C.) | Time (days) | Pass/ Fail | Pressure (psi) |
|---|---|---|---|---|---|---|
| 15 | D | 200 | 0 | 1 | Pass | 1.0 |
| | | | | 17 | Fail | — |
| 16 | D | 200 | 0 | 1 | Pass | 2.5 |
| | A | 2.3 | | 17 | Fail | — |
| | | | | 35 | Fail | — |
| 17 | D | 200 | 0 | 1 | Pass | 2.0 |
| | A | 4.5 | | 17 | Pass | 8.0 |
| | | | | 32 | Pass | 10.3 |
| 18 | D | 200 | 0 | 1 | Pass | 2.0 |
| | A | 9.0 | | 17 | Pass | 13.7 |
| | | | | 32 | Pass | 9.8 |
| 19 | D | 200 | 0 | 1 | Pass | 2.0 |
| | A | 90 | | 17 | Pass | 5.2 |
| | | | | 32 | Pass | 9.8 |

As can be seen from Table 4, after 17 days the fuel compositions comprising ester alone (15), and ester plus a low relative amount of Additive A (16) both failed after 17 days; whereas the fuel compositions with a higher ratio of A:ester continued to pass, even after 32 days. Experiment 19, wherein the ratio of A:ester was 0.45, gave the best result, the pressure drop across the filter always remaining below 10 psi.

We claim:

1. A diesel fuel oil composition comprising a major amount of a diesel fuel oil containing not more than 0.05% by weight of sulphur and having a 95% distillation point of not greater than 350° C., and a minor amount of a lubricity additive composition consisting essentially of (a) an ashless dispersant comprising an acylated nitrogen compound and (b) a polycarboxylic acid, wherein the acid has from 2 to 50 carbon atoms, and wherein the ratio of component (a): component (b), calculated on a weight:weight basis, is in the range of greater than 1:100 to 2:1.

2. The composition according to claim 1 wherein the acylated nitrogen compound has a hydrocarbyl substituent of at least 10 aliphatic carbon atoms and is made by reacting a carboxylic acid acylating agent with at least one amine compound containing at least one —NH— group, said acylating agent being linked to said amino compound through an imido, amido, amidine or acyloxy ammonium linkage.

3. The composition according to claim 1 wherein the acylating agent is a substituted succinic or propionic acid and the amino compound is a polyamine or mixture of polyamines.

4. The composition according to claim 1 wherein the acylated nitrogen compound comprises a hydrocarbyl-substituted succinimide or hydrocarbyl succinimide prepared by reacting a poly(isobutylene)-substituted succinic anhydride acylating agent wherein the poly(isobutylene)-substitutent has between 30 and 400 carbon atoms with a mixture of ethylene polyamines having 3 to 7 amino nitrogen atoms per ethylene polyamine and 1 to 6 ethylene groups.

5. The composition according to claim 1 wherein (b) is a dicarboxylic acid.

6. The composition according to claim 1 wherein (b) is an acid of general formula $R^1(COOH)_X$ wherein $R^1$ represents a hydrocarbyl group having from 2 to 50 carbon atoms, and x represents an integer and is more than 1.

7. The composition of claim 6 wherein x represents 2 to 4.

8. The composition according to claim 6 wherein $R^1$ has 10 to 40 carbon atoms.

9. The composition of claim 8, wherein (b) is a dimer acid formed by dimerisation of unsaturated fatty acids.

10. The composition according to claim 9 wherein (b) is formed from linoleic or oleic acid, or mixtures thereof.

11. The composition according to claim 1 wherein the ratio of (a):(b), on a weight:weight basis, is in the range of 1:2 to 2:1.

12. The composition according to claim 1 wherein the fuel oil has a cetane number of at least 50.

13. The composition according to claim 2 wherein the acylated nitrogen compound comprises a hydrocarbyl-substituted succinimide or hydrocarbyl succinimide prepared by reacting a poly(isobutylene)-substituted succinic anhydride acylating agent wherein the poly(isobutylene)-substitutent has between 30 and 400 carbon atoms with a mixture of ethylene polyamines having 3 to 7 amino nitrogen atoms per ethylene polyamine and 1 to 6 ethylene groups.

14. The composition according to claim 1 wherein component (a) comprises a succinimide ashless dispersant being the reaction product of about 1.5 equivalents of polyisobutyl succinic anhydride with about one equivalent of a polyethylene amine and component (b) comprises a mixture of dimer fatty acid predominating in dilinoleic acid.

15. A method of improving the lubricity performance of a diesel fuel oil containing not more than 0.05% by weight of sulphur and having a 95% distillation point of not greater than 350° C., the method comprising adding to the diesel fuel oil a lubricity improving amount of a lubricity additive wherein the lubricity additive consists essentially of (a) an ashless dispersant comprising an acylated nitrogen compound and (b) a Polycarboxylic acid, wherein the acid has from 2 to 50 carbon atoms, wherein the ratio of component (a): component (b), calculated on a weight:weight basis, is in the range of greater than 1:100 to 2:1.

16. The method of claim 15, wherein the lubricity performance of the diesel fuel oil is improved in the injection pump of a compression-ignition internal combustion engine.

17. The method of claim 15 wherein the lubricity performance of the diesel fuel oil is improved in a high pressure injection unit injector.

* * * * *